US006077034A

United States Patent [19]

Tomita et al.

[11] Patent Number: 6,077,034

[45] Date of Patent: Jun. 20, 2000

[54] BLADE COOLING AIR SUPPLYING SYSTEM OF GAS TURBINE

[75] Inventors: Yasuoki Tomita; Hiroki Fukuno; Yukihiro Hashimoto; Kiyoshi Suenaga, all of Takasago, Japan

[73] Assignee: Mitsubishi Heavy Industries, Ltd., Tokyo, Japan

[21] Appl. No.: 09/038,451

[22] Filed: Mar. 11, 1998

[30] Foreign Application Priority Data

Mar. 11, 1997 [JP] Japan ..... 9-056268

[51] Int. Cl.[7] ..... F01D 5/18; F01D 9/06

[52] U.S. Cl. ..... 415/110; 415/114; 415/115; 415/116; 415/117; 415/176; 415/180; 415/173.7

[58] Field of Search ..... 415/110–112, 114–117, 415/176, 180, 173.7; 416/95, 96 R, 96 A, 97 R

[56] References Cited

U.S. PATENT DOCUMENTS

| | | | |
|---|---|---|---|
| 2,919,891 | 1/1960 | Oliver | 415/115 |
| 3,945,758 | 3/1976 | Lee | 415/115 |
| 4,113,406 | 9/1978 | Lee et al. | 415/115 |
| 5,352,087 | 10/1994 | Antonellis | 415/115 |
| 5,488,825 | 2/1996 | Davis et al. | 415/115 |

FOREIGN PATENT DOCUMENTS

| | | | |
|---|---|---|---|
| 59-79006 | 5/1984 | Japan | 416/97 R |
| 938247 | 10/1963 | United Kingdom | 415/115 |

*Primary Examiner*—Christopher Verdier
*Attorney, Agent, or Firm*—Alston & Bird LLP

[57] ABSTRACT

In the present disclosure, an air pipe extends through a stationary blade between outer and inner shrouds. Further, an air passage is directed to a lower portion of the stationary blade and is communicated with the air pipe so that a serpentine cooling passage is formed. The air enters a cavity from the air passage and is discharged to a gas passage through an air hole, a passage and a seal. Thus, the cavity is sealed at a high pressure. Cooling air is supplied from the air passage to a rotating blade through a cooling air hole, a cooling air chamber, a radial hole and a lower portion of a platform. The stationary blade is cooled by the air through the air passage. The cooling air can be supplied to the rotating blade at a low temperature and a high pressure as they are. Accordingly, the air can be also supplied to the rotating blade when a rotor is cooled by vapor.

5 Claims, 4 Drawing Sheets

BLADE COOLING AIR SUPPLYING SYSTEM OF GAS TURBINE

FIELD OF THE INVENTION AND RELATED ART STATEMENT

The present invention relates to a blade cooling air supplying system for effectively cooling a blade of a gas turbine by the air, and particularly to a system which makes it a possible to cool rotating blades (moving blades) by the air when a rotor is cooled by vapor.

FIG. 4 is a cross-sectional view of the interior of a conventional general gas turbine showing a flow of cooling air to a rotating blade. In FIG. 4, reference numerals 50, 51 and 52 respectively designate a stationary blade, an outer shroud and an inner shroud. Reference numeral 60 designates a rotating blade constructed such that this rotating blade 60 is attached to a rotor disk blade root portion 62 of a turbine disk 61 and is rotated between stationary blades 50.

In the gas turbine constructed by the stationary blade 50 and the rotating blade 60 mentioned above, the rotating blade 60 is cooled by the air and is adapted to be cooled by using one portion of the rotor cooling air. Namely, a radial hole 65 is formed in the rotor disk blade root portion 62 and the rotor cooling air 100 is guided to each disk cavity 64. The rotor cooling air 100 is guided through the radial hole 65 to a lower portion of a platform 63, and is supplied to the rotating blade 60.

FIG. 3 is a detailed view of the stationary and rotating blades in the gas turbine of the above construction. In FIG. 3, the stationary blade 50 has the outer shroud 51 and the inner shroud 52. An air pipe 53 axially extends through the interior of the stationary blade 50. Namely, in this stationary blade 50, air 110 for the seal is guided from a side of the outer shroud 51 to a cavity 54 and flows out to a passage 56 through a hole 57. A pressure within the passage 56 is increased in comparison with that in a combustion gas passage and one portion of this pressure flows into the combustion gas passage so as to prevent the invasion of a high temperature gas. Reference numeral 55 designates a labyrinth seal similarly used to seal the high temperature gas.

As mentioned above, the cooling air supplied to the rotating blade 60 guides the rotor cooling air 100 into the disk cavity 64 and also guides the rotor cooling air 100 to a shank portion 61 surrounded by a seal plate 66 in a lower portion of the platform 63 through the radial hole 65 extending through the interior of the rotor disk blade root portion 62. The rotor cooling air 100 is then supplied from this shank portion 61 to a passage for cooling the rotating blade 60. The air from a compressor may be also cooled through a cooler instead of usage of one portion of the rotor cooling air and may be guided to the disk cavity 64.

As mentioned above, the blades of the conventional gas turbine are cooled by the air and the rotating blade 60 is particularly cooled by guiding one portion of the rotor cooling air. In recent years, a cooling system using vapor instead of the air has been researched. When a rotor system is cooled by the vapor, no air for cooling can be obtained from the rotor so that no rotating blade can be cooled by the air in the conventional structure.

With respect to the stationary blade 50, as explained with reference to FIG. 3, the air 110 for the seal is blown out to the cavity 54 of the stationary blade 50 from the air pipe 53 extending through the interior of the stationary blade. Thus, the interior of the cavity 54 is held at a high pressure and the pressure of the passage 56 is set to be higher than the pressure of the combustion gas passage so that the invasion of a high temperature gas into the interior of the stationary blade is prevented. Namely, the air 110 for the seal which is blown out to the cavity 54 partially flows out to the high temperature combustion gas passage through the hole 57 and the passage 56. When an amount of this flowing-out air is increased, efficiency of the gas turbine is reduced.

OBJECT AND SUMMARY OF THE INVENTION

Therefore, a first object of the present invention is to provide a blade cooling air supplying system of a gas turbine in which the air for cooling a rotating blade is supplied from a stationary blade to the rotating blade instead of using one portion of the air for cooling a rotor, and the rotating blade can be also cooled by the air when a vapor cooling system is adopted to cool the rotor.

A second object of the present invention is to provide a blade cooling air supplying system of a gas turbine having a structure for effectively supplying the air for sealing the stationary blade in addition to the above first object.

A third object of the present invention is the same as the first object with respect to the supply of the cooling air from the stationary blade to the rotating blade, but also is to provide a blade cooling air supplying system of the gas turbine in which this cooling air from an air supplying system is utilized as the air for the seal and can cool the rotating blade.

Therefore, the present invention provides the following (1), (2) and (3) means to respectively achieve the above-mentioned first, second and third objects.

(1) A blade cooling air supplying system of a gas turbine characterized in that the gas turbine has plural rotating blades each attached to a rotor through a blade root portion and also has plural stationary blades arranged alternately with the rotating blades such that each of the stationary blades has outer and inner shrouds, a cavity for the seal in a lower portion of the inner shroud, and a seal box in a lower portion of the cavity for the seal, and the blade cooling air supplying system comprises an air pipe extending through each of said stationary blades from the outer shroud to the inner shroud and inserted into said seal box, a rotating blade side cooling air introducing portion arranged in the blade root portion of each of said rotating blades and guiding cooling air to each of said rotating blades, and a cooling air passage arranged in said seal box and communicating with said air pipe and opened toward an inlet of said rotating blade side cooling air introducing portion, and the cooling air is sent to said air pipe and is blown out from said cooling air passage to the inlet of said rotating blade side cooling air introducing portion and is sent from the rotating blade side cooling air introducing portion to each of said rotating blades.

(2) In the above (1), the entirely of the air supplied to said air pipe out of the cooling air supplied from an outer shroud side of each stationary blade is supplied to each of said rotating blades, and the cooling air supplied to a leading edge portion passage among the air for cooling each stationary blade is sent as the air for the seal to the cavity of each of said stationary blades.

(3) A blade cooling air supplying system of a gas turbine characterized in that the gas turbine has plural rotating blades each attached to a rotor through a blade root portion and also has plural stationary blades arranged alternately with the rotating blades such that each of the stationary blades has outer and inner shrouds, a cavity for the seal in a lower portion of the inside shroud, and a seal box in a lower portion of the cavity for seal, and the blade cooling air supplying system comprises an air passage extending through each of said stationary blades from the outer shroud to the inner shroud and communicating with said cavity, a rotating blade side cooling air passage arranged in the blade root portion of each of said rotating blades and guiding cooling air to each of said rotating blades, and a seal box side cooling air passage arranged in said seal box and connecting said cavity to said rotating blade side cooling air passage, and said cavity is set to have a pressure higher than that of a combustion gas passage by sending the cooling air to the air passage of each of said stationary blades, and the cooling air is sent to each of said rotating blades through said rotating blade side cooling air passage.

In the above (1) of the present invention, the cooling air is supplied from the air pipe of each stationary blade and is blown out to the inlet of the cooling air introducing portion on a rotating blade side from the cooling air passage arranged in the seal box. The cooling air is then guided from the cooling air introducing portion to the rotating blade. However, this cooling air can be directly supplied from the stationary blade to the rotating blade at a high pressure and a low temperature as it is. Accordingly, similar to the conventional air cooling for cooling the rotating blade by one portion of the rotor cooling air, the rotating blade can be effectively cooled by the air. Such a blade cooling air supplying system can be used as an air cooling system for the blades in a gas turbine in which the rotor is cooled by vapor.

In the above (2) of the present invention, the entirety of the cooling air from the air pipe is used to cool the rotating blade. The air for sealing the stationary blade is separately transmitted through a leading edge portion of the stationary blade and cools this leading edge portion. Thereafter, this air is used to pressurize the cavity. Accordingly, in addition to the effects of the above (1) of the present invention, the cooling air is effectively utilized.

Further, in the above (3) of the present invention, the cooling air supplied from the air passage of the stationary blade first flows into the cavity and sets an internal pressure of the cavity to be higher than that of the combustion gas passage. Thereafter, the cooling air is guided to the rotating blade side cooling air passage and is supplied to the rotating blade. Accordingly, the cooling air is effectively utilized. As a result, an air amount escaping from a portion between the rotating and stationary blades to the combustion gas passage can be reduced. Similar to the above (1) and (2) of the present invention, the cooling air supplying system for the blades can air cool the blades in a gas turbine in which the rotor is cooled by vapor.

In the above (1) of the present invention, the gas turbine has plural rotating blades each attached to a rotor through a blade root portion and also has plural stationary blades arranged alternately with the rotating blades such that each of the stationary blades has outer and inner shrouds, a cavity for seal in a lower portion of the inner shroud, and a seal box in a lower portion of the cavity for seal, and the blade cooling air supplying system comprises an air pipe extending through each of said stationary blades from the outer shroud to the inner shroud and inserted into said seal box, a rotating blade side cooling air introducing portion arranged in the blade root portion of each of said rotating blades and guiding cooling air to each of said rotating blades, and a cooling air passage arranged in said seal box and communicated with said air pipe and opened toward an inlet of said rotating blade side cooling air introducing portion. Accordingly, the cooling air is blown out to the inlet of the cooling air introducing portion on the rotating blade side from the cooling air passage and is then sent from the cooling air introducing portion on the rotating blade side to each rotating blade. This cooling air can be directly supplied from each stationary blade to the rotating blade at a high pressure and a low temperature as they are. Accordingly, cooling effects of the rotating blade can be improved.

Accordingly, the invention of this (1) can be used as an air cooling system for the blades in a gas turbine in which the rotor is cooled by vapor.

With respect to the above (2) of the present invention, in the invention of the above (1), the entirety of the cooling air supplied to said air pipe out of the cooling air supplied from an outer shroud side of each stationary blade is supplied to each of said rotating blades, and the cooling air supplied to a leading edge portion passage among the air for cooling each of said stationary blades is sent as the air for seal to the cavity of each of said stationary blades. Accordingly, the entirety of the cooling air from the air pipe is used to cool each rotating blade. The air for sealing each stationary blade is separately transmitted through a leading edge portion of the stationary blade and cools this leading edge portion. Thereafter, this air is used to pressurize the cavity. Accordingly, in addition to the effects of the above (1) of the present invention, the cooling air is effectively utilized.

The above (3) of the present invention is a blade cooling air supplying system of a gas turbine having rotating and stationary blades similar to those of the above (1) and constructed such that the blade cooling air supplying system comprises an air passage extending through each of said stationary blades from the outside shroud to the inner shroud and communicated with said cavity, a rotating blade side cooling air passage arranged in the blade root portion of each of said rotating blades and guiding cooling air to each of said rotating blades, and a seal box side cooling air passage arranged in said seal box and connecting said cavity to said rotating blade side cooling air passage. Accordingly, the cooling air first flows into the cavity and sets an internal pressure of the cavity to be higher than that of the combustion gas passage. Thereafter, the cooling air is guided to the rotating blade side cooling air passage and is supplied to each rotating blade. Accordingly, the cooling air is efficiently utilized. As a result, the amount of air escaping from a portion between the rotating and stationary blades to the combustion gas passage can be reduced.

Accordingly, similar to the above (1) and (2) of the present invention, the invention of the above (3) can be also used as a system for air cooling the blades in a gas turbine in which the rotor is cooled by vapor.

DETAILED DESCRIPTION OF THE PREFERRED EMBODIMENTS

Figure 1:
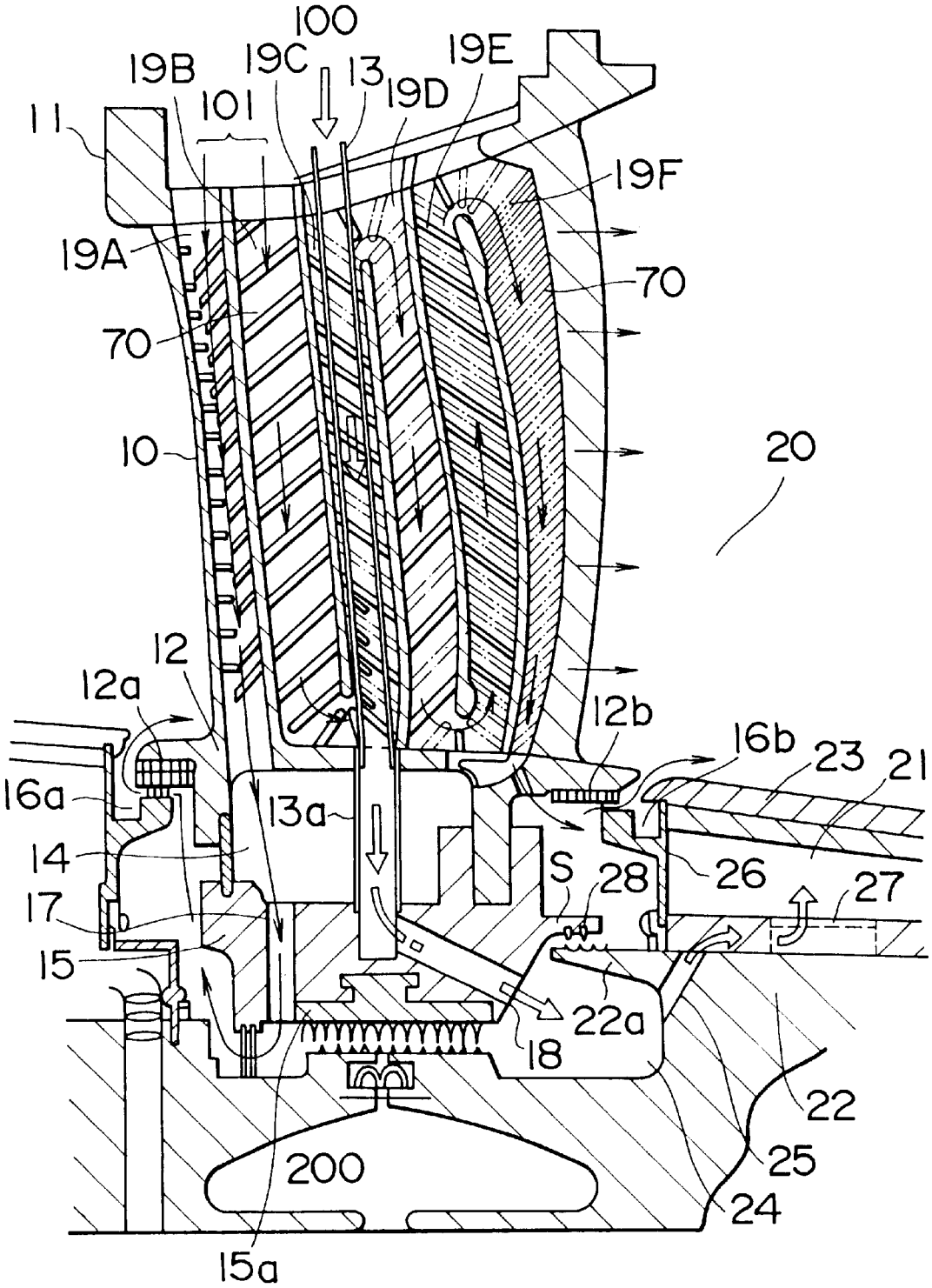
FIG. 1 is a cross-sectional view of root portions of stationary and rotating blades to which a blade cooling air supplying system in accordance with a first embodiment of the present invention is applied.

The embodiment modes of the present invention will next be described in detail on the basis of the drawings. FIG. 1 is a cross-sectional view of a blade portion to which a blade cooling air supplying system of a gas turbine in accordance with a first embodiment of the present invention is applied.

In FIG. 1, reference numeral 10 designates a stationary blade having an outside shroud 11 and an inner shroud 12. Reference numeral 13 designates an air pipe extending through the interior of the stationary blade and the air 100 for cooling is guided by this air pipe 13. Reference numeral 14 designates a cavity arranged in a lower portion of the inner shroud 12. A tube 13*a* connected to the air pipe 13 hermetically passes through the interior of the cavity 14. Reference numeral 15 designates a seal box for supporting a labyrinth seal 15*a*. Reference numerals 16*a* and 16*b* designate passages formed by seal portions 12*a*, 12*b* of the inner shroud 12 in both end portions thereof. Reference numeral 17 designates an air hole extending through the seal box 15 and communicating the cavity 14 with the passage 16*a*. Reference numeral 18 designates a cooling air passage arranged in the seal box 15. The cooling air passage 18 communicates the tube 13*a* continuously connected to the air pipe 13 with a cooling air chamber 24 on a rotating blade side. An air passage 19A for the seal guides the air 101 from the outer shroud 11. Air passages 19B, 19C, 19D, 19E and 19F form a serpentine cooling flow passage.

Reference numerals 20, 21 and 22 respectively designate an unillustrated rotating blade, a shank portion and a rotor disk blade root portion. This rotor disk blade root portion 22 has a projecting portion 22*a*. A seal portion 28 is formed between this projecting portion 22*a* and the seal box 15 of the stationary blade 10. Reference numerals 23 and 24 respectively designate a platform and a cooling air chamber in the blade root portion 22. The cooling air chamber 24 is formed by the projecting portion 22*a*, the seal chamber 28, the seal box 15 of the stationary blade 10 and the labyrinth seal 15*a*. The cooling air chamber 24 is communicates with the cooling air passage 18 arranged in the seal box 15 on a stationary blade side.

Reference numeral 25 designates a radial hole formed in the rotor disk blade root portion 22. The radial hole 25 communicates with the cooling air chamber 24 and an air reservoir 27 formed in the blade root portion 22 and the shank portion 21. Namely, an air introducing portion is constructed by the cooling air passage 24, the radial hole 25 and the air reservoir 27. Reference numeral 26 designates a seal plate in a lower portion of the platform 23. The passage 16*b* is formed by the seal plate 26 and the seal portion 12*b* on a stationary blade side. A turbulator 70 is arranged within the air passages 19A to 19F of the stationary blade 10 to provide turbulence to a cooling air flow and improve a heat transfer rate.

In the above first embodiment, the rotor is cooled by vapor and a vapor cavity 200 is arranged. The rotor is cooled by the vapor from the vapor cavity 200. The stationary blade 10 and the rotating blade 20 are cooled by the air. One portion of the air 101 first flows into the interior of the stationary blade from the outside shroud 11 through the passage 19A on a leading edge side. This air cools the leading edge and is blown out to the cavity 14 and passes through the air hole 17 of the seal box 15 and also passes through the passage 16*a* at a pressure equal to or higher than a predetermined pressure. The air then passes through the seal portion 12*a* and partially flows out onto the side of a high temperature gas passage. Accordingly, a rotor side of the combustion gas passage is held at a pressure higher than the pressure of the combustion gas passage by this air 101 for the seal so that the invasion of a high temperature gas onto the rotor side of the combustion gas passage is prevented.

The remaining portion of the air 101 enters the passage 19B and is moved upward in the passage 19C from a lower portion of the passage 19B. Serpentine cooling is performed while the remaining portion of the air 101 sequentially passes through the passages 19D, 19E and 19F and is partially discharged from a trailing edge side. After this cooling, the air at a high temperature passes through the passage 16*b* and flows out to a gas flow passage on the trailing edge side from the seal portion 12*b*.

In contrast to this, the cooling air 100 flows into the air pipe 13 from the outside shroud 11 and passes through the tube 13*a* continuously connected to a lower portion of the air pipe 13. The cooling air 100 further enters the cooling air chamber 24 through the cooling air passage 18 and stays as cooling air at a high pressure and a low temperature. The cooling air entering the cooling air chamber 24 further enters the air reservoir 27 through the radial hole 25 on the rotating blade side, and is guided from the platform 23 to an air passage for cooling arranged in an unillustrated rotating blade 20, and cools the rotating blade 20.

In the above-mentioned first embodiment, the air for cooling the rotating blade is supplied from only the air pipe 13 arranged in the stationary blade 10 and the tube 13*a*. The air pipe 13 and the tube 13*a* constitute an independent route. Accordingly, the air for cooling the rotating blade is directly supplied to the rotating blade 20 while the high pressure and the low temperature of the air are maintained. Therefore, the rotating blade 20 can be effectively cooled.

The air 101 for sealing within the cavity 14 is independently supplied from the passage 19A at a leading edge. The air 101 passing through this passage 19A cools a leading edge portion and is then used as a seal. Accordingly, the air 101 can be used for both sealing and cooling so that the air can be effectively utilized.

In the blade cooling air supplying system in the first embodiment having such features, the air can be also supplied to the blades, especially the rotating blade 20 in the case of a gas turbine for cooling the rotor by vapor. Accordingly, the blades can be cooled by the air.

Figure 2:
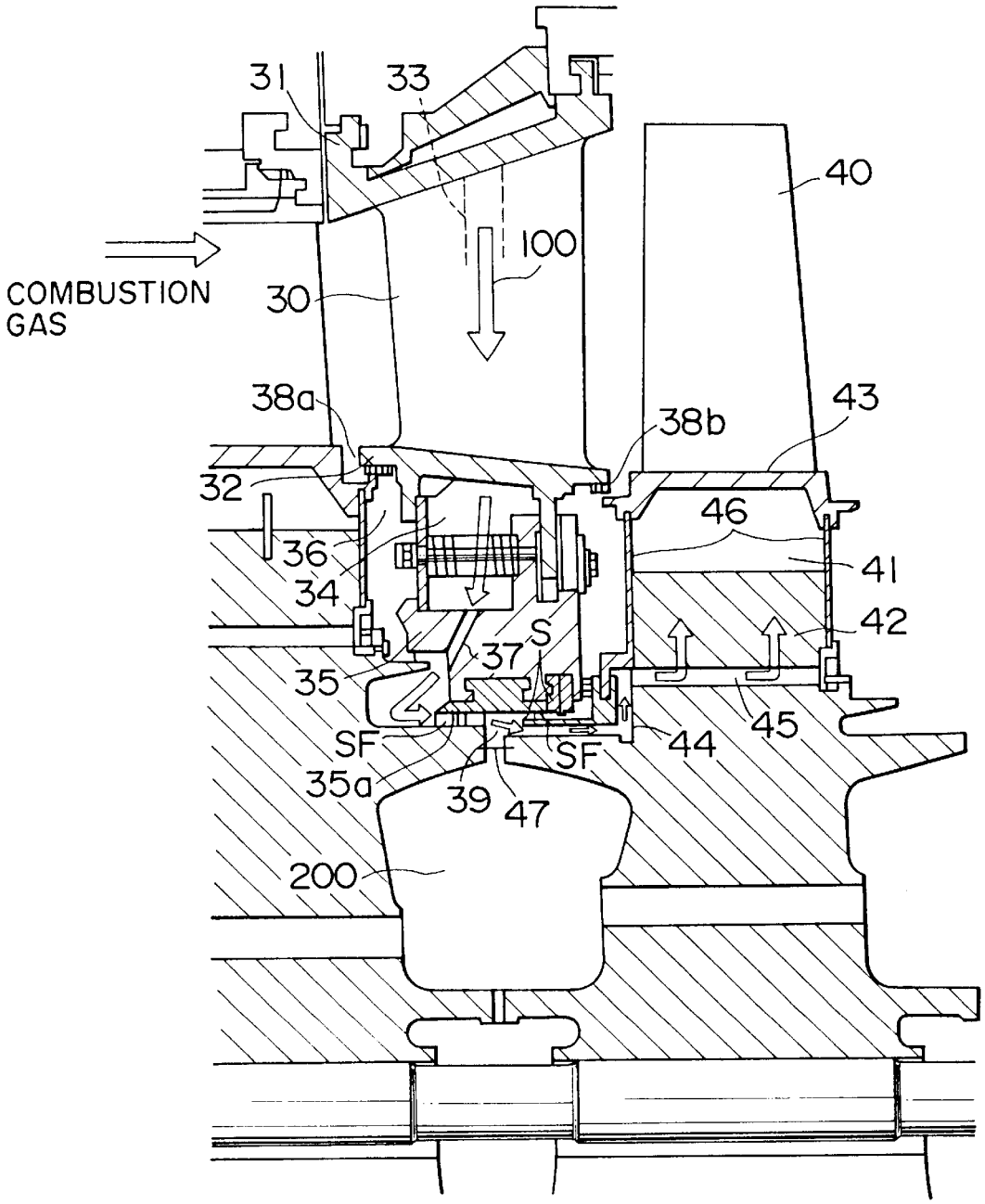
FIG. 2 is a cross-sectional view of root portions of stationary and rotating blades to which a blade cooling air supplying system in accordance with a second embodiment of the present invention is applied.
Figure 3:
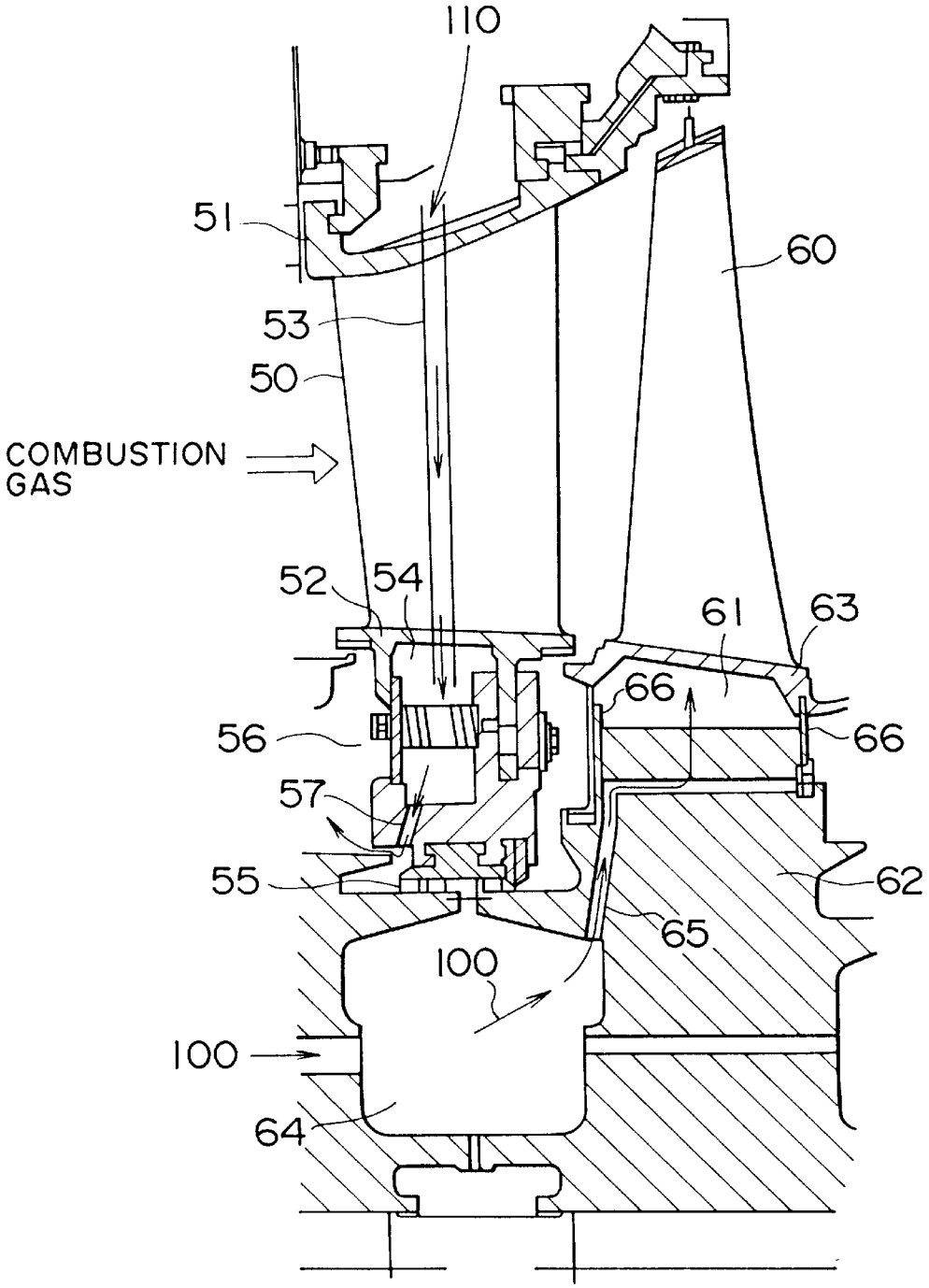
FIG. 3. (PRIOR ART)
FIG. 3 is a cross-sectional view of a rotating blade in which a cooling air supplying system to the rotating blade of a conventional gas turbine is applied.
Figure 4:
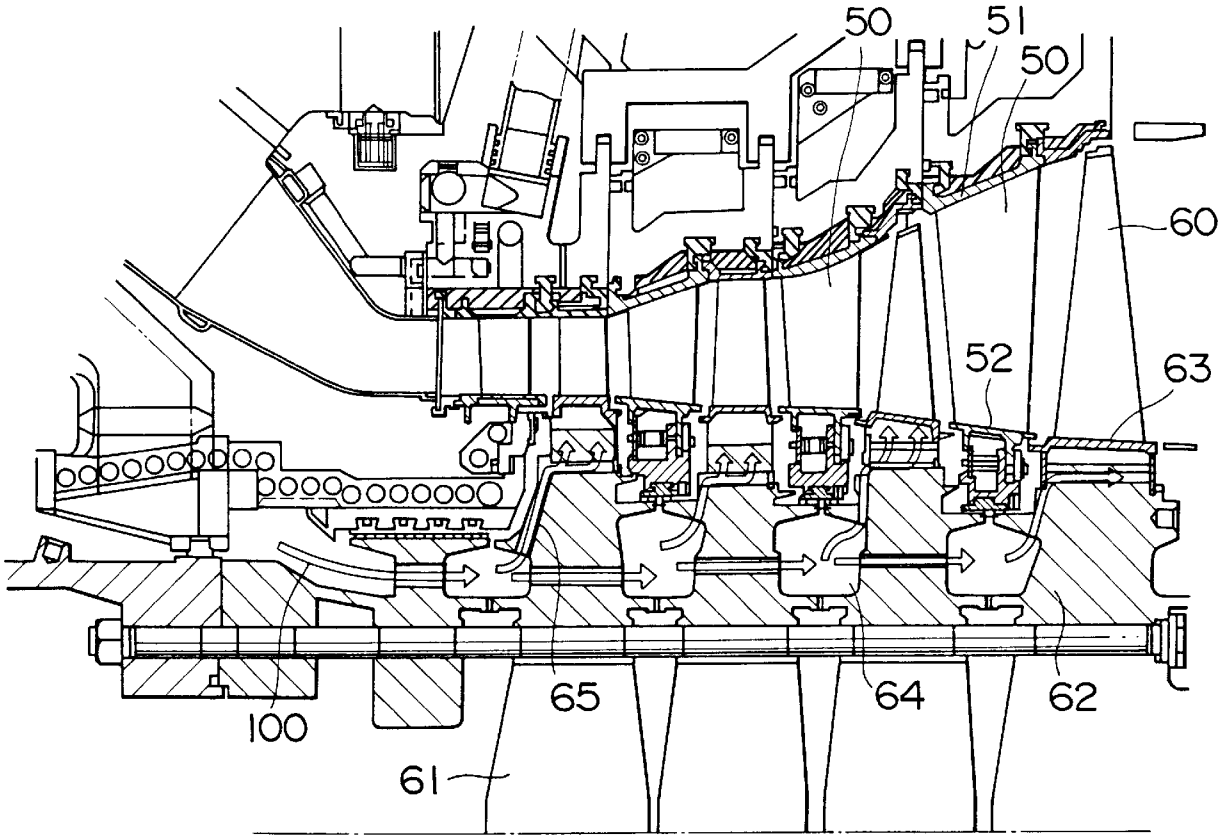
FIG. 4. (PRIOR ART)
FIG. 4 is a cross-sectional view of a blade portion of the conventional gas turbine showing a flow of cooling air to the rotating blade.

FIG. 2 is a cross-sectional view of a blade portion to which a blade cooling air supplying system in accordance with a second embodiment of the present invention is applied. In FIG. 2, this second embodiment is characterized in that one portion of the air supplied from a stationary blade to cool a rotating blade can be also utilized as the air for sealing the stationary blade, and the air escaping from a portion between the rotating and stationary blades to a combustion gas passage is reduced by effectively utilizing the air. These features will next be explained.

In FIG. 2, a stationary blade 30 has an outer shroud 31 and an inner shroud 32. Reference numeral 33 designates an air passage within the stationary blade. This air passage 33 may be formed within the stationary blade and may be also formed by arranging a tube. Reference numerals 34 and 35 respectively designate a cavity and a seal box. The seal box 35 supports a labyrinth seal 35*a* for sealing a portion between the seal box 35 and a rotating blade 40. Reference numerals 36 and 37 respectively designate a passage and an air passage. The air passage 37 is formed in the seal box 35 and communicates the cavity 34 with the passage 36. Reference numerals 38*a* and 38*b* designate seals between an end portion of the inside shroud 32 of the stationary blade 30 and an end portion of a platform 43 of the rotating blade 40 described later. Reference numeral 39 designates an air reservoir formed between the labyrinth seal 35*a* and a baffle plate 47. The baffle plate 47 is arranged between the labyrinth seal 35*a* and a rotor disk blade root portion 42 of the rotating blade 40.

Reference numerals 40, 41 and 42 respectively designate a rotating blade and a shank portion formed in a lower portion of the platform 43, and a rotor disk blade root portion. Reference numerals 44 and 45 respectively designate cooling air passages. The cooling air passage 44 is formed such that this cooling air passage 44 extends through a rotor disk. The cooling air passage 44 communicates with the air reservoir 39 and the cooling air passage 45 of the rotor disk blade root portion 42. Air passage portions of the rotor disk blade root portion 42 and the shank portion 41 are sealed by a seal plate 46 and the supplied cooling air does not escape to a combustion gas passage, but is reliably supplied to the rotating blade 40. In FIG. 2, reference numerals S and SF respectively designate a seal and a seal fin.

In the second embodiment of the above construction, the cooling air 100 from a compartment side flows into the cavity 34 from the interior of the stationary blade through the air passage 33. The cooling air 100 then passes through the air passage 37 and enters the air reservoir 39 through the labyrinth seal 35*a* at a pressure equal to or higher than a predetermined pressure. One portion of the air flowing out through the air passage 37 passes through the passage 36. When this air has a pressure equal to or higher then that of a combustion gas at a high pressure, the air passes through a seal 38*a* and flows out to the combustion gas passage. Thus, the interior of the cavity 34 is held at a pressure higher than that of the combustion gas passage so that the invasion of a high pressure combustion gas onto a rotor side of the combustion gas passage is prevented.

The cooling air of the air reservoir 39 passes through the cooling air passages 44 and 45 and enters the shank portion 41 via an unillustrated passage formed in the rotor disk blade root portion 42. The cooling air is then supplied to a passage for cooling the rotating blade 40 and cools the rotating blade 40. After this cooling, the air is discharged to the combustion gas passage. Both sides of the shank portion 41 and the blade root portion 42 formed in a lower portion of the platform 43 are sealed by the seal plate 46 so that the cooling air can be reliably supplied to the rotating blade 40 without escaping this cooling air to the combustion gas passage.

In the second embodiment explained above, the cooling air 100 supplied from the air passage 33 of the stationary blade 30 is reliably supplied to the rotating blade 40 without escape of this cooling air to the combustion gas passage, and can cool the rotating blade 40. Further, one portion of the cooling air of the air passage 33 is supplied to the cavity 34 as the air for sealing. Accordingly, the air for sealing is sent to the cavity 34 by forming a dedicated passage for seal air, and the amount of air escaping to the combustion gas passage can be reduced in comparison with a system for almost escaping the air to the combustion gas passage.

Similar to the blade cooling air supplying system in the first embodiment, the cooling air can be also supplied to the rotating blade 40 in such a blade cooling air supplying system in the second embodiment even in the case of a gas turbine for cooling the rotor by vapor. Accordingly, the rotating blade can be cooled by the air.

What is claimed is:

1. A blade cooling air supplying system of a gas turbine which comprises: a plurality of rotating blades each attached to a rotor through a blade root portion, and a plurality of stationary blades arranged alternatively with the rotating blades such that each stationary blade has outer and inner shrouds, a cavity for a respective seal in a lower portion of each inner shroud, and a respective seal box operatively associated with each of said stationary blades in a lower portion of each cavity for a seal; an air pipe extending through each of said stationary blades from the outer shroud to the inner shroud and inserted into each respective seal box; a plurality of rotating blade side cooling air introducing portions each being arranged in the blade root portion of a respective rotating blade and being adapted to guide cooling air to the respective rotating blade; and cooling air passages, each arranged in a respective one of said respective seal boxes and communicating with said air pipe of said respective seal box and opening toward an inlet of an adjacent one of said rotating blade side cooling air introducing portions; wherein the cooling air is sent to each of said air pipes and is blown out from said cooling air passages to the inlets of said rotating blade side cooling air introducing portions and is sent from the rotating blade side cooling air introducing portions to each rotating blade;

wherein substantially all of the air supplied to said air pipes from an outer shroud side of the stationary blades is supplied to the rotating blades, and cooling air supplied to a leading edge portion passage out of each of said stationary blades is sent as air for sealing to the cavity of each stationary blade.

2. A blade cooling air supplying system of a gas turbine according to claim 1 wherein each said cavity is set to have a pressure higher than an external pressure of the cooling air sent to the air passages of the stationary blades and at least a portion of the cooling air is sent to the rotating blades through said rotating blade side cooling air introducing portions.

3. A gas turbine comprising:

a row of stationary blades;

a row of rotating blades adjacent the row of stationary blades, each rotating blade having a blade root;

a rotor attached to the blade roots for supporting the rotating blades, the rotor and blade roots having cooperating cooling air inlet passages for supplying cooling air through the rotor into the rotating blades;

inner and outer shrouds connected to inner and outer ends, respectively, of the stationary blades;

at least one cooling air supply passage extending from the outer shroud through each stationary blade and through the inner shroud;

a structure supported beneath the inner shroud adjacent the rotor and having a seal cavity arranged to receive cooling air from the cooling air supply passages of the stationary blades;

a seal air flow path connected to the seal cavity for delivering air from the seal cavity through a seal portion of the inner shroud at a forward end thereof into a main gas turbine flow path to prevent high-temperature combustion gas in the main gas turbine flow path from entering the seal cavity;

a first set of passages in the structure adapted to supply cooling air from the seal cavity to a rotor cooling air passage defined between the structure and the rotor; and the cooling air inlet passages in the rotor being arranged to deliver cooling air from the rotor cooling air passage through the cooling air inlet passages in the blade roots and into the rotating blades for cooling the rotating blades;

said at least one cooling air passage in the stationary blades comprises a first cooling air passage extending from the outer shroud through a leading edge portion of each stationary blade and through the inner shroud into the seal cavity for supplying seal air to the seal cavity, and a second cooling air passage extending from the outer shroud through each stationary blade and through the inner shroud into the seal cavity;

the structure including a second set of passages which connect the seal cavity to the seal air flow path;

and further comprising a tube hermetically connecting each second cooling air passage to one of the first set of passages in the structure, whereby cooling air supplied through the second cooling air passages in the stationary blades is supplied through the rotor to the rotating blades for cooling thereof.

4. A gas turbine comprising:

a row of stationary blades;

a row of rotating blades adjacent the row of stationary blades, each rotating blade having a blade root;

a rotor attached to the blade roots for supporting the rotating blades, the rotor and blade roots having cooperating cooling air inlet passages for supplying cooling air through the rotor into the rotating blades;

inner and outer shrouds connected to inner and outer ends, respectively, of the stationary blades;

at least one cooling air supply passage extending from the outer shroud through each stationary blade and through the inner shroud;

a structure supported beneath the inner shroud adjacent the rotor and having a seal cavity arranged to receive cooling air from the cooling air supply passages of the stationary blades;

a seal air flow path connected to the seal cavity for delivering air from the seal cavity through a seal portion of the inner shroud at a forward end thereof into a main gas turbine flow path to prevent high-temperature combustion gas in the main gas turbine flow path from entering the seal cavity;

a first set of passages in the structure adapted to supply cooling air from the seal cavity to a rotor cooling air passage defined between the structure and the rotor; and the cooling air inlet passages in the rotor being arranged to deliver cooling air from the rotor cooling air passage through the cooling air inlet passages in the blade roots and into the rotating blades for cooling the rotating blades;

wherein the structure includes a rotor seal which seals against the rotor, and wherein the first set of passages in the structure supply air in the seal cavity to an air space between the structure and the rotor adjacent the rotor seal, the seal air flow path being connected to the air space, the rotor and the structure further defining an air reservoir therebetween which is separated from the air space by the rotor seal and which is connected to the rotor cooling air passage, the rotor seal being adapted to permit a portion of the air in the air space to enter the reservoir for cooling the rotating blades, the remainder of the air in the air space flowing through the seal air flow path.

5. A gas turbine comprising:

a row of stationary blades;

a row of rotating blades adjacent the row of stationary blades, each rotating blade having a blade root;

a rotor attached to the blade roots for supporting the rotating blades, the rotor and blade roots having cooperating cooling air inlet passages for supplying cooling air through the rotor into the rotating blades;

inner and outer shrouds connected to inner and outer ends, respectively, of the stationary blades;

at least one cooling air supply passage extending from the outer shroud through each stationary blade and through the inner shroud;

a structure supported beneath the inner shroud adjacent the rotor and having a seal cavity arranged to receive cooling air from the cooling air supply passages of the stationary blades;

a seal air flow path connected to the seal cavity for delivering air from the seal cavity through a seal portion of the inner shroud at a forward end thereof into a main gas turbine flow path to prevent high-temperature combustion gas in the main gas turbine flow path from entering the seal cavity;

a first set of passages in the structure adapted to supply cooling air from the seal cavity to a rotor cooling air passage defined between the structure and the rotor; and the cooling air inlet passages in the rotor being arranged to deliver cooling air from the rotor cooling air passage through the cooling air inlet passages in the blade roots and into the rotating blades for cooling the rotating blades;

wherein the structure comprises a seal box attached to the inner shroud, and wherein the rotor includes a vapor space therein and vapor cooling passages connected to the vapor space and extending through the rotor for vapor cooling the rotor, and further comprising a seal disposed between the seal box and the rotor and separating the seal air flow path from the rotor cooling air passage, and a baffle plate between the seal and the rotor, whereby the rotor is cooled by vapor and the rotating blades are cooled by air which is passed through the stationary blades.

* * * * *